US008755539B2

(12) United States Patent
Huang et al.

(10) Patent No.: US 8,755,539 B2
(45) Date of Patent: Jun. 17, 2014

(54) ELECTROSTATIC TRANSDUCER LOUDSPEAKER

(75) Inventors: Pei-Cheng Huang, Taipei (TW); Jwin-Yen Guo, Jhubei (TW)

(73) Assignee: Richtek Technology Corp., Hsinchu (TW)

( * ) Notice: Subject to any disclaimer, the term of this patent is extended or adjusted under 35 U.S.C. 154(b) by 387 days.

(21) Appl. No.: 12/947,148

(22) Filed: Nov. 16, 2010

(65) Prior Publication Data

US 2011/0116657 A1 May 19, 2011

(30) Foreign Application Priority Data

Nov. 19, 2009 (TW) ..... 098221537

(51) Int. Cl.
*H04R 3/00* (2006.01)

(52) U.S. Cl.
USPC ..... 381/116; 381/119; 381/120; 330/251; 330/195

(58) Field of Classification Search
CPC ..... H04R 3/00; H04R 19/005; H04R 19/01; H04R 19/013; H04R 19/00; H04R 19/02; H03F 3/217; H03F 2200/384; H03K 7/08
USPC ..... 381/116, 111, 150, 191, 117, 120; 330/251, 270 A, 270 R, 250, 276, 262, 330/154, 152, 10, 195
See application file for complete search history.

(56) References Cited

U.S. PATENT DOCUMENTS 7,332,962 B2 * 2/2008 Wu et al. ..... 330/251
2004/0047477 A1 * 3/2004 Bank et al. ..... 381/120

* cited by examiner

*Primary Examiner* — Vivian Chin
*Assistant Examiner* — Con P Tran
(74) *Attorney, Agent, or Firm* — Muncy, Geissler, Olds & Lowe, P.C.

(57) ABSTRACT

An electrostatic transducer loudspeaker includes a filterless class-D amplifier to modulate an audio input signal to generate a modulated signal containing a PWM switching carrier component, and a transformer directly connected at an output side of the filterless class-D amplifier and directly connected at an input side of an electrostatic transducer, whereby the equivalent capacitance of the electrostatic transducer and the equivalent inductance of the transformer establish a resonance circuit to demodulate the modulated signal to generate an AC voltage to drive the electrostatic transducer.

1 Claim, 3 Drawing Sheets

ELECTROSTATIC TRANSDUCER LOUDSPEAKER

FIELD OF THE INVENTION

The present invention is related generally to an electrostatic transducer loudspeaker and, more particularly, to a filterless electrostatic transducer loudspeaker.

BACKGROUND OF THE INVENTION

U.S. Patent Application Publication No. 2007/0121970 discloses an electrostatic transducer whose driving circuit uses a class-D amplifier, and the output of the class-D amplifier is necessarily coupled with a low-pass filter to eliminate the switching carrier components included in the output signal of the class-D amplifier. However, the low-pass filter unavoidably increases the volume and cost of the physical device. While exactly helping to reduce the volume and cost of a physical device, a filterless class-D amplifier is only applicable to inductive transducers. On the other hand, the conventional electrostatic transducer needs a very high direct current (DC) bias voltage, and thus requires a power supply circuit capable of providing the high DC voltage, thereby causing the resultant physical device bulky and costly. U.S. Patent Application Publication No. 2009/0016551 discloses an electrostatic transducer which is needless of DC bias voltage and thus is useful in applications to decrease the volume and cost of a physical device.

SUMMARY OF THE INVENTION

An object of the present invention is to provide a filterless electrostatic transducer loudspeaker.

According to the present invention, an electrostatic transducer loudspeaker includes a filterless class-D amplifier to modulate an audio input signal to generate a modulated signal containing a pulse width modulation (PWM) switching carrier component, a transformer directly connected at an output side of the filterless class-D amplifier, and an electrostatic transducer directly connected at a secondary side of the transformer.

Due to a resonant circuit established by the equivalent capacitance of the electrostatic transducer and the inductance of the transformer, the PWM switching carrier component is removed. Therefore, the electrostatic transducer loudspeaker is able to demodulate the modulated signal to generate an AC voltage to drive the electrostatic transducer without using any filter.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
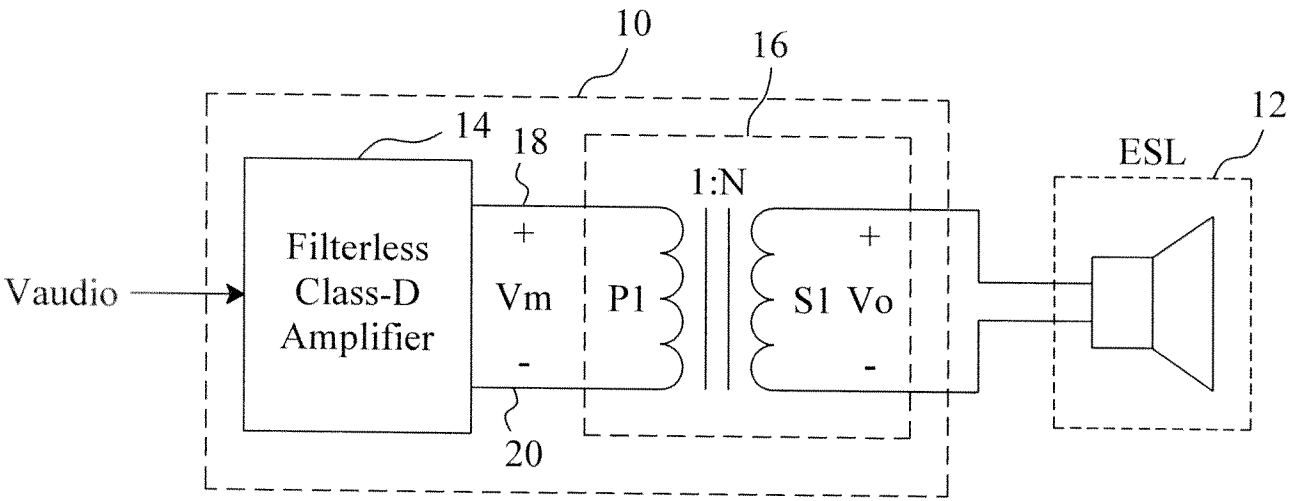
FIG. 1 shows a filterless electrostatic transducer loudspeaker according to the present invention.

FIG. 1 shows an electrostatic transducer loudspeaker according to the present invention, which includes a driving circuit 10 and an electrostatic transducer 12 driven by the driving circuit 10. The electrostatic transducer 12 needs no provision of DC bias voltage and is capable of being directly driven by an alternative current (AC) signal. Readers may refer to U.S. Patent Application Publication No. 2009/0016551 for detailed structure and principle of an electrostatic transducer. In the driving circuit 10, a filterless class-D amplifier 14 modulates the audio input signal Vaudio to generate a modulated signal Vm containing a PWM switching carrier component, a transformer 16 has a primary coil P1 directly connected to the output terminals 18 and 20 of the filterless class-D amplifier 14 and a secondary coil S1 directly connected to the input terminals of the electrostatic transducer 12. In this architecture, there is no filters between the transformer 16 and the filterless class-D amplifier 14, and between the transformer 16 and the electrostatic transducer 12, the modulated signal Vm directly drives the transformer 16, and the combination of the transformer 16 and the electrostatic transducer 12 directly demodulates the modulated signal Vm to generate an AC voltage Vo to drive the electrostatic transducer 12.

Figure 2:
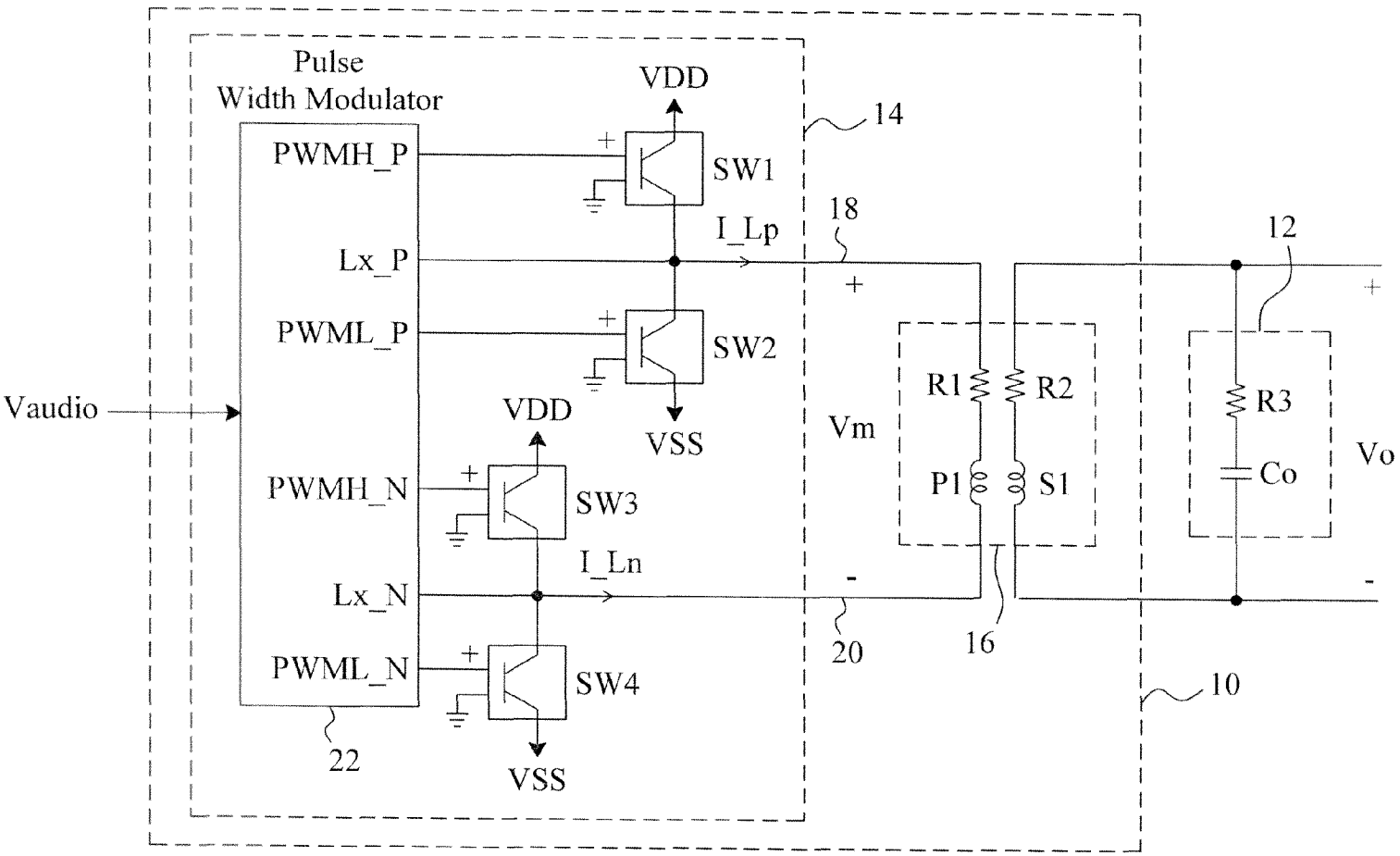
FIG. 2 is an equivalent circuit of the filterless electrostatic transducer loudspeaker shown in FIG. 1.

As shown in FIG. 2, the filterless class-D amplifier 14 includes a pulse width modulator 22 to modulate the audio input signal Vaudio to generate PWM signals PWMH_P, PWML_P, PWMH_N and PWML_N for switching the switches SW1, SW2, SW3 and SW4 of an H bridge, respectively, so that the modulated signal Vm is generated between its output terminals 18 and 20. The equivalent capacitor Co of the electrostatic transducer 12 and the inductor S1 of the transformer 16 establish a resonant circuit to demodulate the modulated signal Vm, so that the AC voltage Vo is generated between the two input terminals of the electrostatic transducer 12 to drive the electrostatic transducer 12. In FIG. 2, R1 is the equivalent resistance of the primary side of the transformer 16, R2 is the equivalent resistance of the secondary side of the transformer 16, and R3 is the equivalent resistance of the electrostatic transducer loudspeaker 12.

Figure 3:
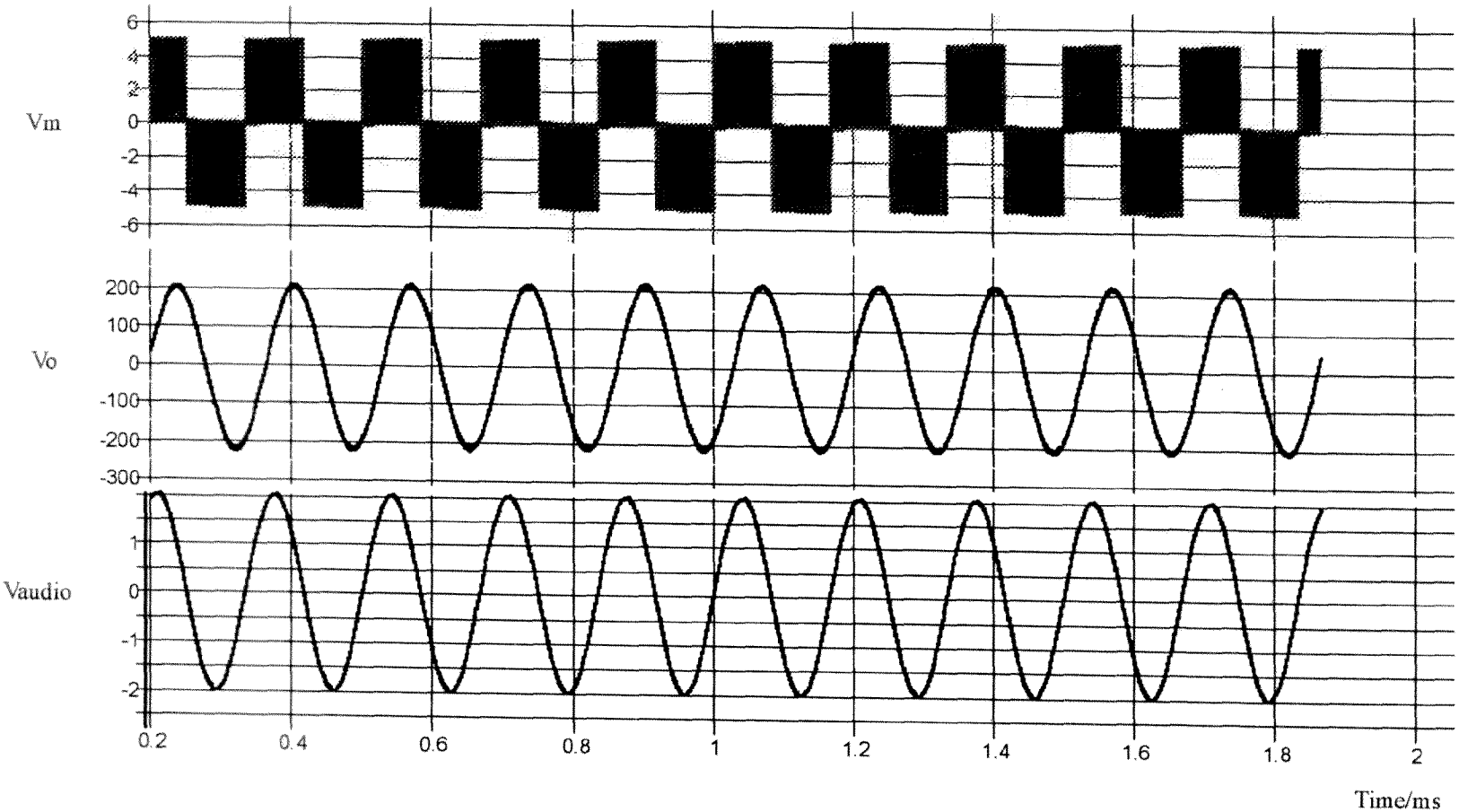
FIG. 3 is a waveform diagram derived from a simulation using the circuit shown in FIG. 2.

FIG. 3 is a waveform diagram derived from a simulation using the circuit shown in FIG. 2. The modulated signal Vm, as a result of pulse width modulation of the audio input signal Vaudio, contains a PWM switching carrier component which has a frequency much higher than the audio frequency and is removed when the AC voltage Vo is generated through demodulation. In this simulation, the capacitance Co is 220 pF, R1 is 16.5Ω, and R2 is 27 KΩ. The resultant AC voltage Vo has a swing range of 400 Vpp, a signal-to-noise ratio (SNR) of 95 dB, and a total harmonic distortion plus noise (THD+N) of 0.13%.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. An electrostatic transducer loudspeaker comprising:

a filterless class-D amplifier for modulating an audio input signal to generate a modulated signal containing a PWM switching carrier component between two output terminals thereof;

a transformer having a primary coil directly connected to the two output terminals of the filterless class-D amplifier; and an electrostatic transducer directly connected to a secondary coil of the transformer;

wherein an equivalent capacitance of the electrostatic transducer and an equivalent inductance of the transformer establish a resonant circuit to demodulate the modulated signal to generate an AC voltage to drive the electrostatic transducer.

* * * * *